US006668942B1

(12) United States Patent
Lin

(10) Patent No.: US 6,668,942 B1
(45) Date of Patent: Dec. 30, 2003

(54) DAMPING APPARATUS FOR RECIPROCATING PNEUMATIC TOOLS

(76) Inventor: Ching-Tien Lin, No. 192, Tali 2nd St., Tali City, Taichung Hsien (TW)

( * ) Notice: Subject to any disclaimer, the term of this patent is extended or adjusted under 35 U.S.C. 154(b) by 0 days.

(21) Appl. No.: 10/335,942

(22) Filed: Jan. 3, 2003

(51) Int. Cl.[7] ..... B25D 9/04

(52) U.S. Cl. ..... 173/211; 173/168; 173/162.1

(58) Field of Search ..... 173/210, 211, 173/168, 169, 162.1, 206, 114, 162.2; 227/10

(56) References Cited

U.S. PATENT DOCUMENTS 2,899,934 A * 8/1959 Salengro ..... 173/211
4,776,408 A * 10/1988 Elkin et al. ..... 173/162.1
5,311,948 A * 5/1994 Kimberlin ..... 173/211
5,573,075 A * 11/1996 Henry et al. ..... 173/162.1
5,813,477 A * 9/1998 Clay et al. ..... 173/211
6,123,243 A * 9/2000 Pfister et al. ..... 227/10
6,192,997 B1 * 2/2001 Tsai et al. ..... 173/210

* cited by examiner

*Primary Examiner*—Scott A. Smith
(74) *Attorney, Agent, or Firm*—Bacon & Thomas, PLLC

(57) ABSTRACT

A damping apparatus for a reciprocating pneumatic tool mainly includes a cylindrical damper. The damper has a front opening and an enlarged rear end. The front opening is attached to a cylinder of the reciprocating pneumatic tool. A damping segment is formed between the front opening and the enlarged rear end of the damper. A spiral slot is defined longitudinally through the enlarged rear end of the damper. Several slots are defined parallel and transversely in the damping segment of the damper and communicate with the spiral slot. The damping segment has gaps arranged longitudinally by the slots such that the structure has high internal damping to attenuate shock that is caused by return movement of a piston in the cylinder. Consequently, a user holding the pneumatic tool can feel comfortable.

7 Claims, 7 Drawing Sheets

DAMPING APPARATUS FOR RECIPROCATING PNEUMATIC TOOLS

BACKGROUND OF THE INVENTION

1. Field of the Invention

The present invention relates to a damping apparatus for reciprocating pneumatic tools, and more particularly to a damping apparatus for reciprocating pneumatic tools that can dissipate impact during recoil generated by the reciprocating movement in a pneumatic tool.

2. Description of Related Art

Reciprocating pneumatic tools are used to crush stones or break hard objects. With reference to FIGS. 6 and 7, a reciprocating pneumatic tool generally has a cylinder (30), a bi-directional valve (40), a gun-shaped body (50) and a piston (60). The cylinder (30) has a front opening (not numbered) and a rear end (not numbered), and a channel (31) is defined longitudinally through the rear end of the cylinder (30) to communicate with the front opening in the cylinder (30). The front opening in the cylinder (30) is adapted to hold a tool head (70) that is used to break hard objects or the like. The piston (60) is slidably mounted in the channel (31) and is pushed by compressed air to impact the tool head (70).

The rear end of the cylinder (30) is screwed into the gun-shaped body (50) with the bi-directional valve (40). The gun-shaped body (50) includes a top holder (51) and a handle (52). The rear end of the cylinder (30) is screwed into the top holder (51), and the bi-directional valve (40) is attached to the rear end of the cylinder (30) in the top holder (51). To create a reciprocating movement of the piston (60) in the channel (31), the flow of the compressed air in the channel (31) must be bi-directional. A return airway (32) is defined longitudinally in the cylinder (30) through the rear end and communicates with the channel (31) near the front opening of the cylinder (30). Two exhaust ports (33) are defined centrally in the cylinder (30) between the front opening and the rear end of the cylinder (30).

Besides providing means to hold the reciprocating pneumatic tool, the handle (52) is adapted to guide compressed air into the holder (51). The compressed air will flow into the channel (31) via the bi-directional valve (40). The bi-directional valve (40) has inlets (41), a forward outlet (42), a return outlet (42') and a disk (43) and is attached to the rear end of the cylinder (30) in the holder (51). The forward outlet (42) communicates with the channel (31), and the return outlet (42') communicates with the return airway (32). The disk (43) is movably mounted between the two outlets (42, 42') and selectively covers one of the outlets (42, 42') at a time.

With reference to FIG. 6, the piston (60) is at rest and the disk (43) covers forward outlet (42) to the channel (31). When the compressed air flows through the inlets (41) into the bi-directional valve (40), the compressed air will flow into the channel (31) via the return airway (32) to force the piston (60) to move toward the bi-directional valve (40). When the piston (60) moves past the exhaust ports (33), the piston (60) will compress the air in the channel (31) between the piston (60) and the bi-directional valve (40). The compressed air pushes the disk (43) that closes the return outlet (42') in the bi-directional valve (40).

With reference to FIG. 7, the compressed air will flow into the channel (31) via the forward outlet (42) when the disk (43) covers the return outlet (42'). The piston (60) is pushed forward by the compressed air and impacts the tool head (70). Similarly, the movement of the piston (60) compresses the air in the channel (31) between the piston (60) and the tool head (70) and the air flow into the return airway (32) pushes the disk (43) to cover the forward outlet (42) in the bi-directional valve (40).

Consequently, the piston (60) will repeatedly impact the tool head (70) to break hard objects. However, the piston (60) will also impact the bi-directional valve (40) during the return. Impact energy created by the piston (60) will be transmitted to the handle (50) and cause vibrations and shock in the pneumatic tool. The user operating the reciprocating pneumatic tool will feel uncomfortable because of the vibrations and shock. After extensive use, the user will feel fatigued and may suffer a chronic injury by the vibrations and shock.

To overcome the shortcomings, the present invention provides a damping apparatus for a pneumatic toll to absorb and dissipated the impact energy during the return to mitigate or obviate the aforementioned problems.

SUMMARY OF THE INVENTION

The main objective of the invention is to provide a damping apparatus for a reciprocating pneumatic tool to absorb and dissipate impact energy during the return such that the pneumatic tool is comfortable to be held when breaking hard objects.

Other objectives, advantages and novel features of the invention will become more apparent from the following detailed description when taken in conjunction with the accompanying drawings.

DETAILED DESCRIPTION OF PREFERRED EMBODIMENT

Figure 1:
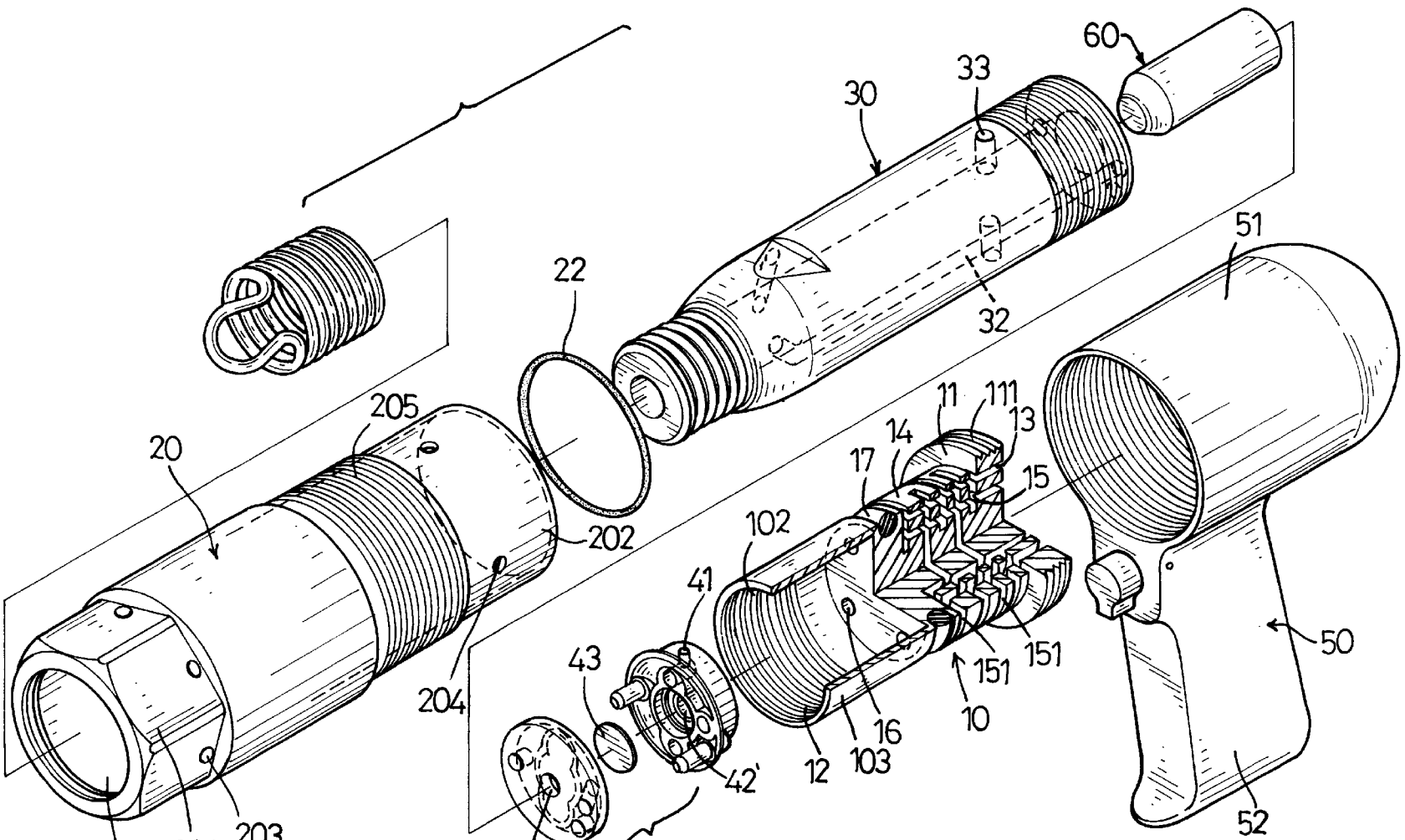
FIG. 1 is an exploded perspective view in partial section of a reciprocating pneumatic tool with a damping apparatus in accordance with the present invention.
Figure 3:
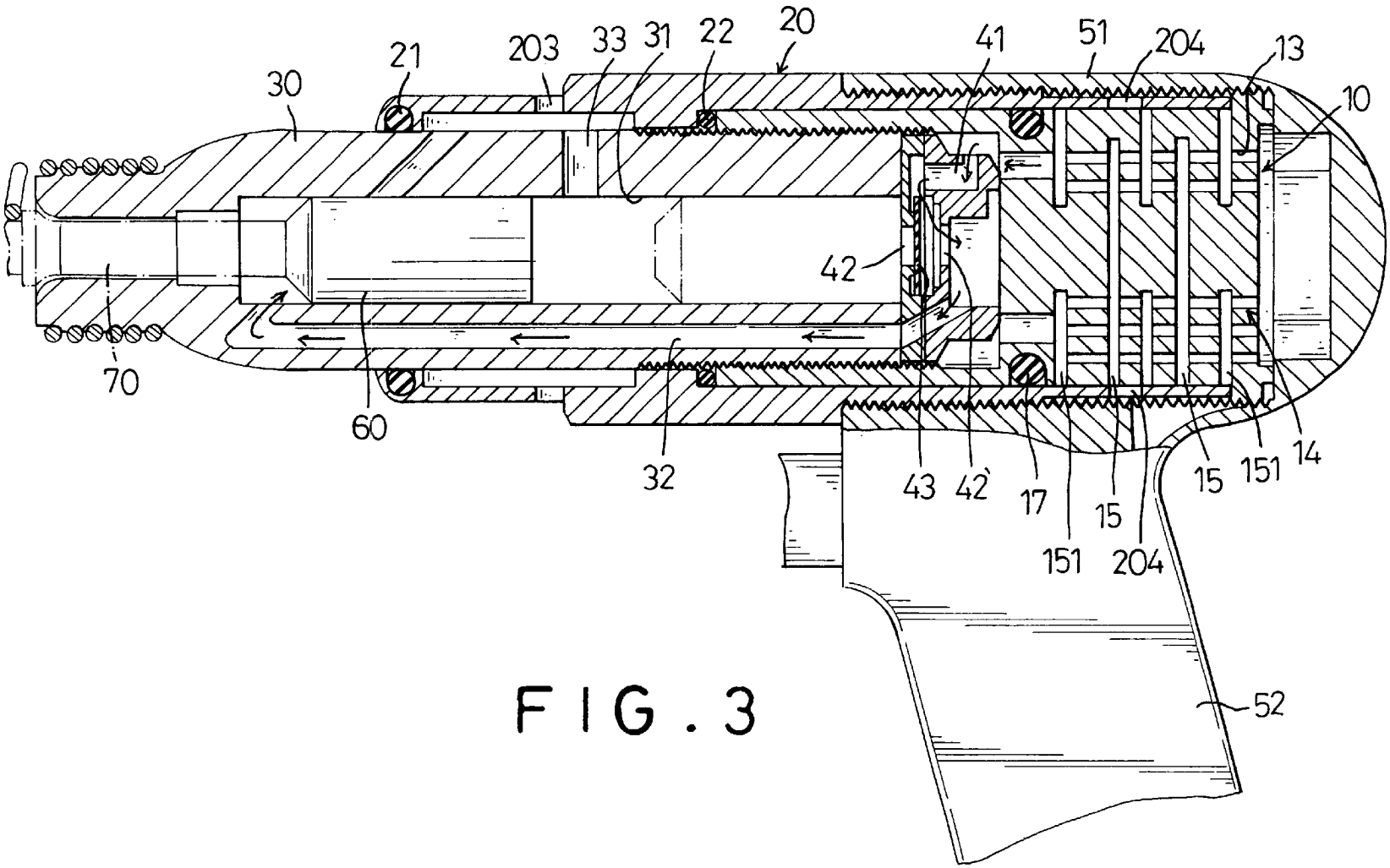
FIG. 3 is an operational side plan view in partial section of the reciprocating pneumatic tool in FIG. 1 showing a piston of the pneumatic tool pressed toward the damper by compressed air.

With reference to FIGS. 1 and 3, a damping apparatus in accordance with the present invention is adapted to mount in a reciprocating pneumatic tool. The damping apparatus comprises a damper (10) and a protector (20). The pneumatic tool comprises a cylinder (30), a bi-directional valve (40), a gun-shaped body (50) and a piston (60). The structure of the reciprocating pneumatic tool is conventional.

Therefor, a detailed description of the reciprocating pneumatic tool is omitted.

The gun-shaped body (50) has a top holder (51) and a handle (52), and the damper (10) is mounted in holder (51) of the gun-shaped body (50). The cylinder (30) has a front opening (not numbered), a rear end (not numbered), a channel (31), a return airway (32) and two exhaust ports (33) configured conventionally. The rear end of the cylinder (30) is screwed into the damper (10). The bi-directional valve (40) is attached to the rear end of the cylinder (30) inside the damper (10) and has inlets (41), a forward outlet (42), a return outlet (42') and a disk (43). The piston (60) is movably mounted in the channel (31) in the cylinder (30). The protector (20) is partly mounted in the holder (51) of the gun-shaped body (50) around the damper (10) and the cylinder (30).

Figure 2:
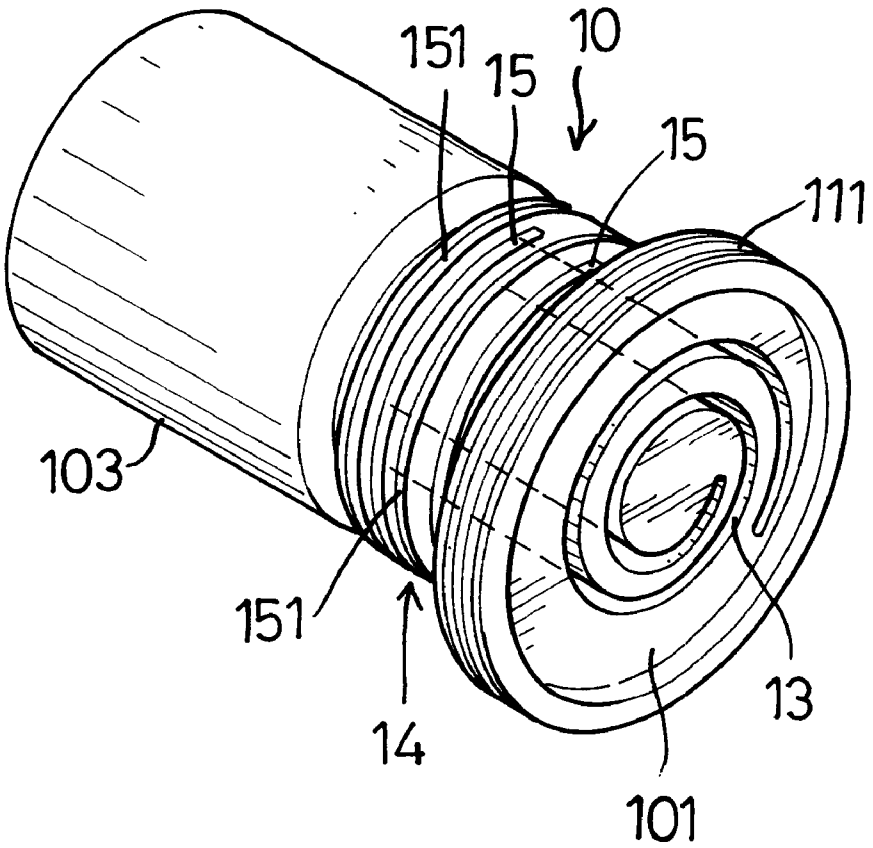
FIG. 2 is a perspective rear view of a damper for the damping apparatus in FIG. 1.

With reference to FIGS. 1 and 2, the damper (10) has an enlarged rear end (101), a front opening (102) and an outer periphery (103). An annular lip (11) with an external thread (111) is formed on the outer periphery (103) near the enlarged rear end (101) of the damper (10), and the external thread (111) is adapted to screw into the holder (51) of the gun-shaped body (50). An internal thread (12) is formed around the front opening (102) of the damper (10) and is adapted to screw onto the rear end of the cylinder (30). A spiral slot (13) is defined through the rear end (101) of the damper (10). A damping segment (14) is formed in the damper (10) between the rear end (101) and the front opening (102) of the damper (10). Multiple first slots (15) are defined transversely in the damping segment (14) and parallel to each other. A cross sectional area of each first slot (15) is equal to three quarters of the cross sectional area of the damping segment (14). Multiple second annular slots (151) are radially defined in and around the outer periphery (103). The first and the second annular slots (15, 151) are arranged alternately and both of them communicate with the spiral slot (13). Multiple longitudinal holes (16) are defined in the damping segment (14) through the front opening to communicate with the spiral slot (13) and one of the adjacent first and second annular slots (15, 151). An O-ring (17) is mounted around the outer periphery (103) of the damper (10) at a position corresponding to the longitudinal holes (16) to seal the compressed air.

With reference to FIGS. 1 and 3, the protector (20) is cylindrical and has a hexagonal front end (201), a rear opening (202), an outer surface (not numbered) and an inner surface (not numbered) with a shoulder (not numbered). Multiple exhaust holes (203) are defined radially in the hexagonal front end (201) of the protector (20) and vent the compressed air from the exhaust ports (33) in the cylinder (30). Multiple supply ports (204) are defined around the protector (20) near the rear opening (202), and the compressed air passes through the supply ports (204). An external thread (205) is defined on the outer surface of the protector (20) between the supply ports (204) and the exhaust holes (203) and screws into the holder (51) of the gun-shaped body (50). A central hole (206) is defined axially in the hexagonal front end (201) of the protector (20) and an O-ring (21) is attached around the central hole (206). The shoulder is formed between the supply ports (204) and the exhaust holes (203) in the protector (20) on the inner surface of the protector (20). Another 0-ring (22) abuts the shoulder on the inner surface of the protector (20) and is clamped between the front opening (102) of the damper (10) and the shoulder to form a seal.

The piston (60) is movably mounted in the channel (31) of the cylinder (30). The rear end of the cylinder (30) is screwed into the front opening (102) of the damper (10) with the bi-directional valve (40) inside the front opening (102) of the damper (10). The protector (20) screws into the top holder (51) of the gun-shaped body (50) and houses the cylinder (30) and the damping segment (14) of the damper (10). The rear opening of the protector (20) abuts the annular lip (11) of the damper (10). The front opening of the cylinder (30) passes through the central hole (206) in the hexagonal front end (201) of the protector (20) and is adapted to hold a tool head (70).

Figure 4:
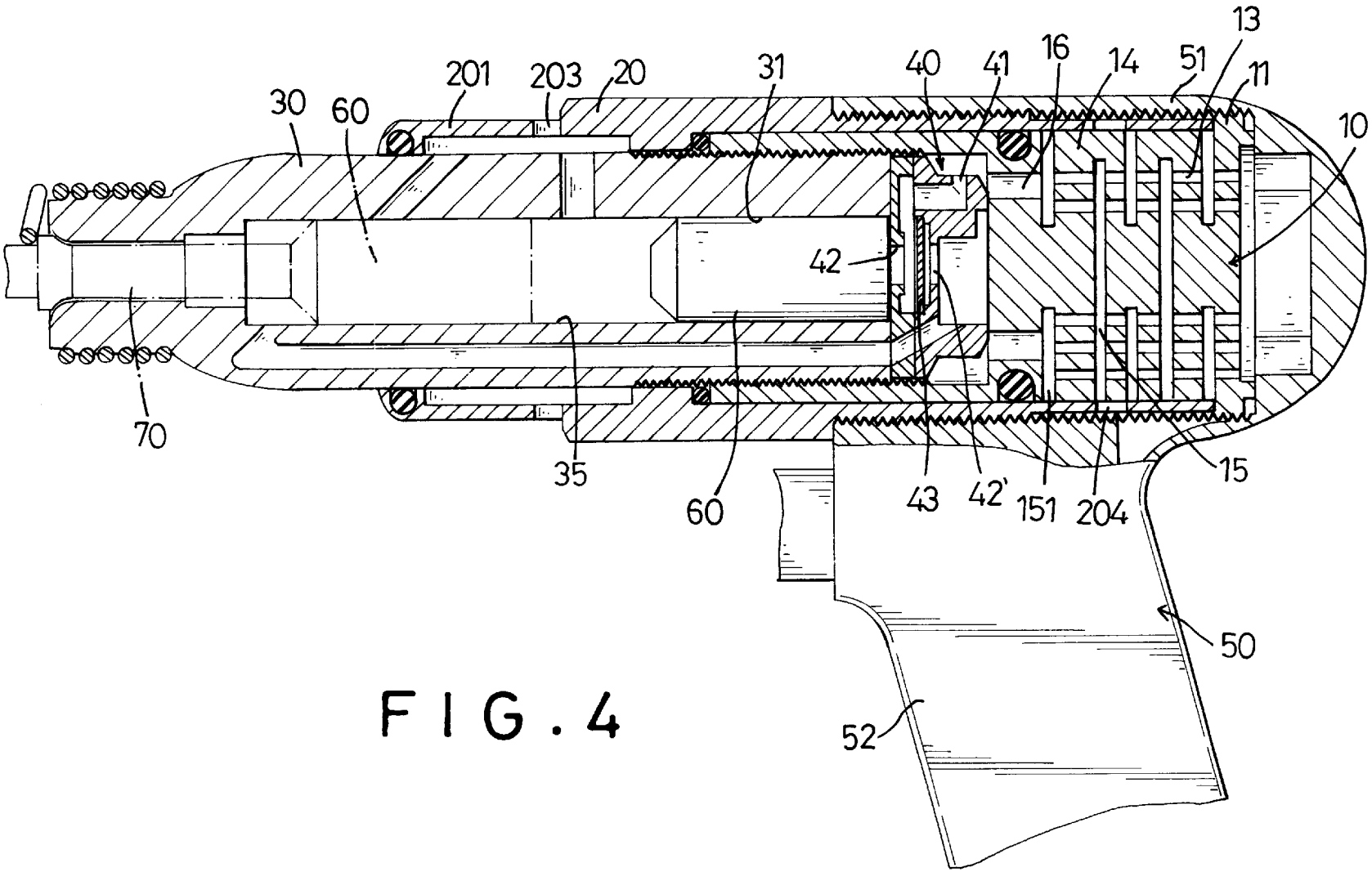
FIG. 4 is an operational side plan view in partial section of the reciprocating pneumatic tool in FIG. 1 showing the piston of the pneumatic tool pressed away from the damper by compressed air.
Figure 5:
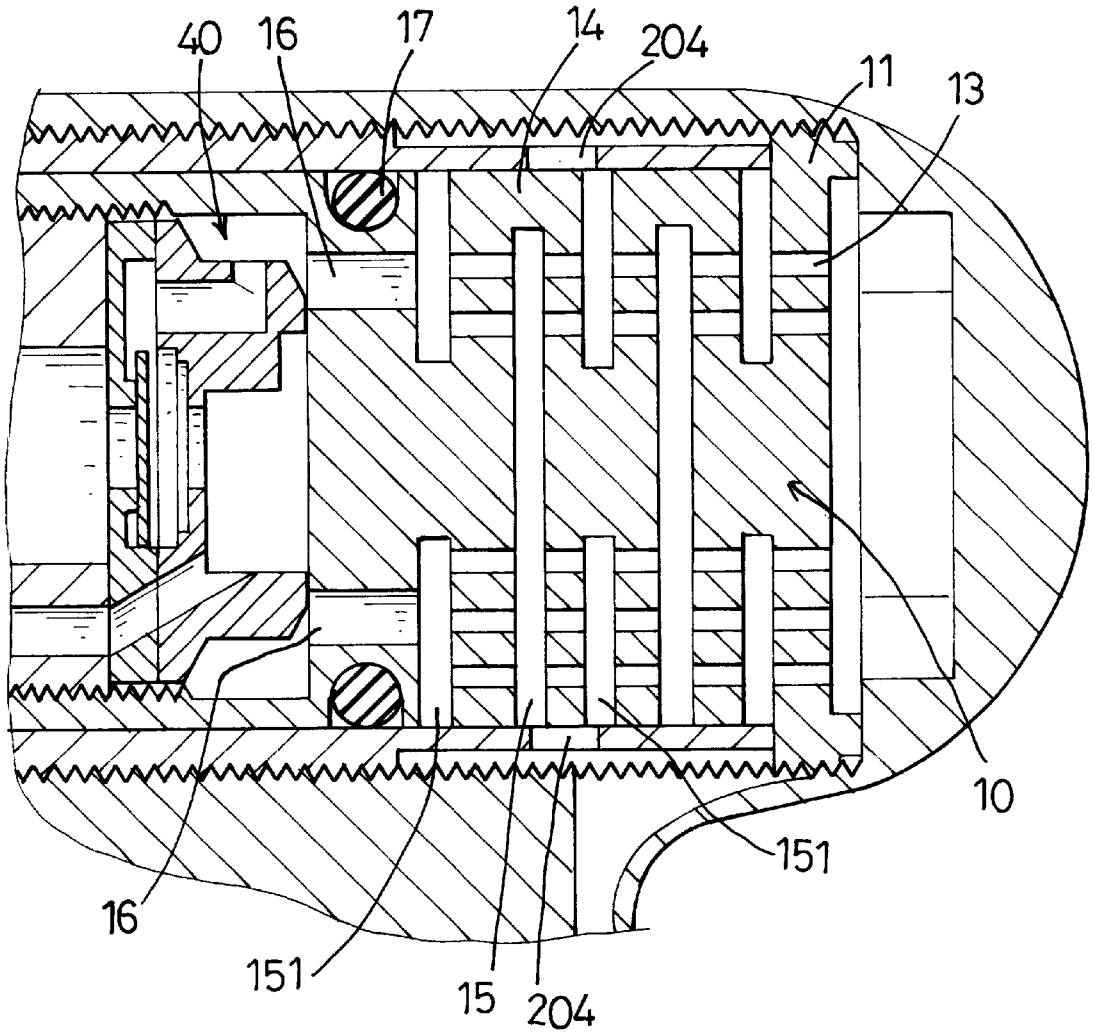
FIG. 5 is an enlarged cross sectional side plan view of the damper in FIG. 2.
Figure 6:
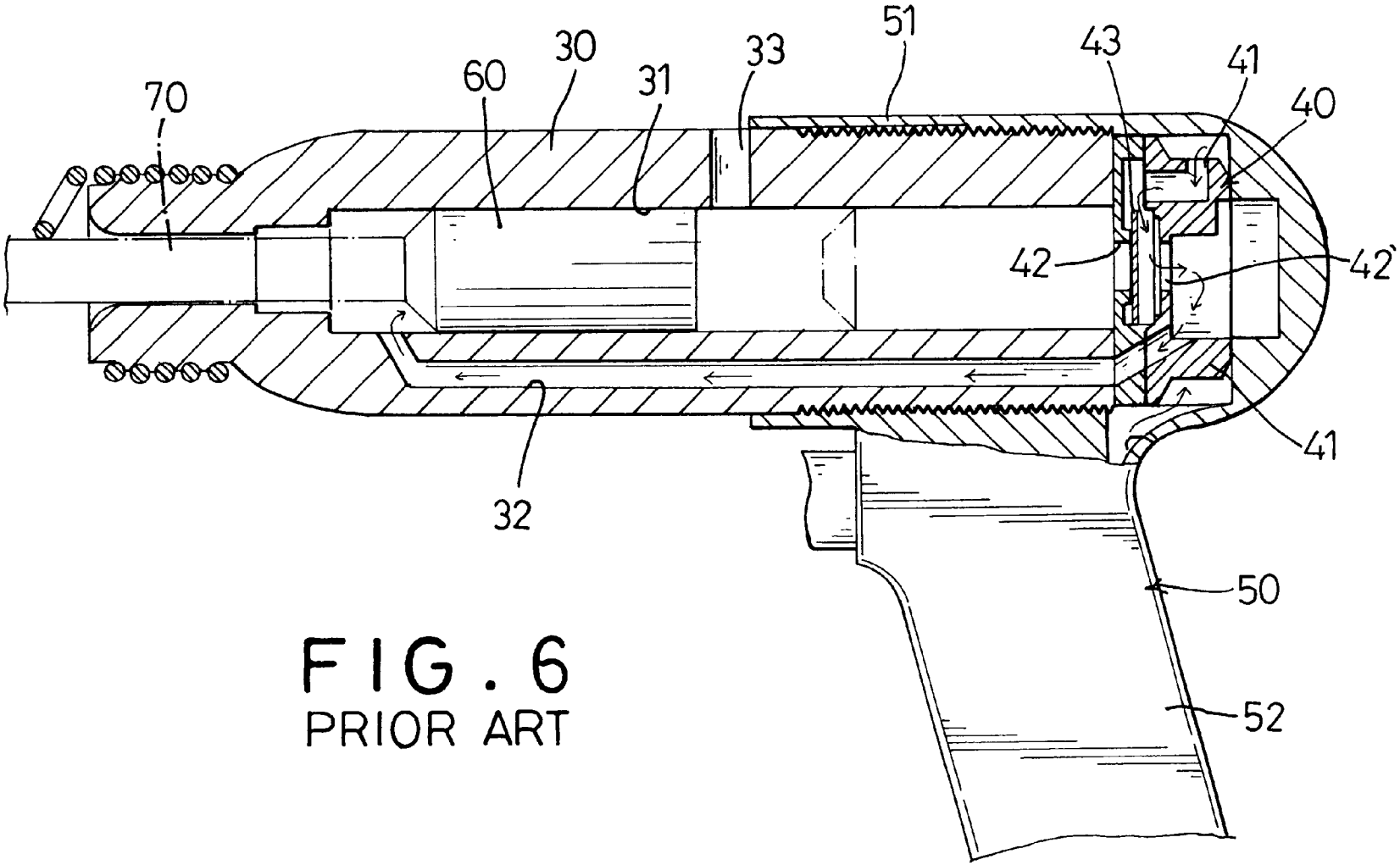
FIG. 6 PRIOR ART
FIG. 6 is an operational side plan view in partial section of a conventional reciprocating pneumatic tool.
Figure 7:
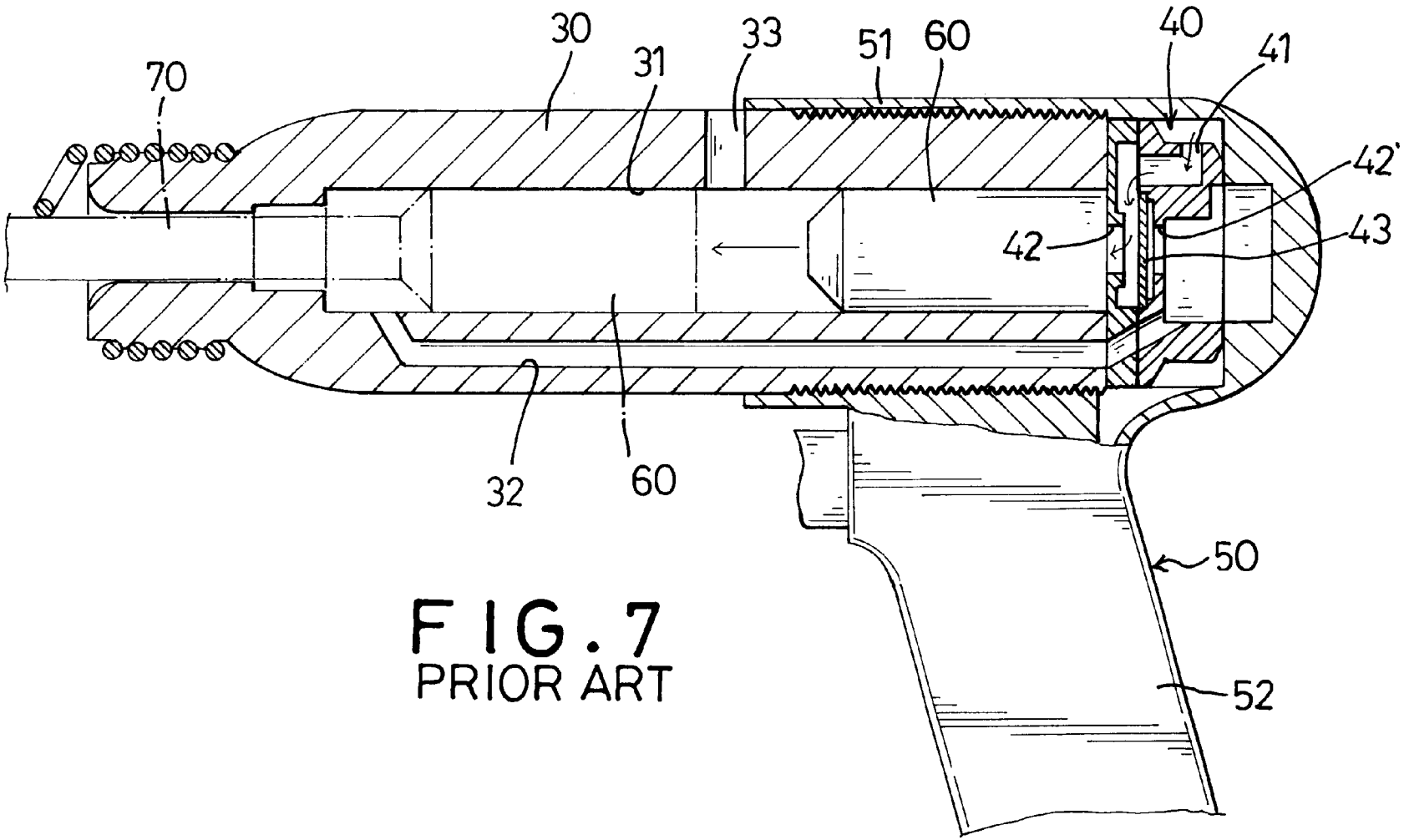
FIG. 7 PRIOR ART
FIG. 7 is an operational side plan view in partial section of the conventional reciprocating pneumatic tool in FIG. 6 the piston pressed by the compressed air to impact a tool head.

With reference to FIGS. 4 and 5, compressed air flows into the slots (15, 151, 13) in the damping segment (14) of the damper (10). Then, the compressed air flows into the bi-directional valve (40) through the inlets (41) via the longitudinal holes (16) in the damper (10). The compressed air flows through the forward outlet (42) and pushes the piston (60) that strikes the tool head (70).

When the piston (60) is pushed toward the damper (10) by the compressed air flowing through the return airway (32), the piston (60) will impact the bi-directional valve (40) and generate a shock that is transmitted to the damper (10). The shock caused by the piston (60) impacting the bi-directional valve (40) will deform the damping segment (14) of the damper (10). When the damping segment (14) of the damper (10) is slightly deformed, the impact energy will be absorbed and dissipated in the damper (10). Because the damping segment (14) is partially segment by the first slots (15) and the second annular slots (151), the damping segment (14) is somewhat resilient and will attenuate the shock. The impact energy is not transmitted into the solid damping segment (14) but into the air in the first and second slots (15, 151) to the enlarged rear end (101) of the damper (10). The shock will be transmitted into the handle (52) through the enlarged rear end (101) of the damper (10) but is reduced and attenuated in the damping segment (14) of the damper (10). The small shock causes small vibrations and shock such that the user who holds the handle (52) will receive small vibrations and shock and feel comfortable.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A damping apparatus mounted in a reciprocating pneumatic tool having a cylinder with a front opening, a rear end and a channel defined through the rear end and communicating with the front opening and a gun-shaped body, the front opening of the cylinder adapted to hold a tool head and a piston movably mounted in the channel, and the damping apparatus comprising:

a damper adapted to attach to the rear end of the cylinder and the damper having a front opening adapted to be attached to the rear end of the cylinder, a rear end adapted to mount in the gun-shaped body of the reciprocating pneumatic tool, an outer periphery, a damping segment with a cross section formed between the front opening and the rear end of the damper, a spiral slot defined longitudinally through the rear end of the damper, multiple first slots defined transversely in the damping segment and parallel to each other and each first slot communicating with the spiral slot, and multiple longitudinal holes defined in the damping segment through the front opening of the damper and communicating with the spiral slot and one of the adjacent first slots, and a protector mounted around the damper and adapted to partly mounted in the gun-shaped body around the cylinder, and the protector having a hexagonal front end, a rear opening facing the damper, an outer surface, an inner surface with a shoulder, multiple exhaust holes radially defined in the hexagonal front end of the protector, multiple supply ports defined in the protector near the rear opening of the protector, and a central hole defined axially through the hexagonal front end of the protector and adapted for the cylinder passing through the central hole.

2. The damping apparatus as claimed in claim 1, wherein each first slot has a cross section area equal to three quarters of the cross section of the damping segment of the damper.

3. The damping apparatus as claimed in claim 1, wherein multiple second annular slots are defined radially and parallel to each other in the damping segment and communicate with the spiral slot, and the first slots and the second annular slots are arranged alternately.

4. The damping apparatus as claimed in claim 2, wherein multiple second annular slots are defined radially and parallel to each other in the damping segment and communicate with the spiral slot, and the first slots and the second annular slots are arranged alternately.

5. The damping apparatus as claimed in claim 4, wherein an annular lip with an external thread is formed on the outer periphery near the rear end of the damper.

6. The damping apparatus as claimed in claim 5, wherein an O-ring is attached to the outer periphery of the damper at a position corresponding to the longitudinal holes and adapted to seal compressed air.

7. The damping apparatus as claimed in claim 6, wherein the shoulder is formed on the inner surface of the protector between the supply ports and the exhaust holes in the protector, and an O-ring abuts the shoulder and is clamped between the front opening of the damper and the shoulder and adapted to seal compressed air.

* * * * *